US007134713B1

(12) United States Patent
Tseng

(10) Patent No.: US 7,134,713 B1
(45) Date of Patent: Nov. 14, 2006

(54) CHAIR WITH A FOOTREST TURNABLE RELATIVE TO A CHAIR SEAT FRAME

(75) Inventor: Chuen-Jong Tseng, Chiayi Hsien (TW)

(73) Assignee: Taiwan Shin Yen Enterprise Co., Ltd., Chiayi Hsien (TW)

( * ) Notice: Subject to any disclaimer, the term of this patent is extended or adjusted under 35 U.S.C. 154(b) by 11 days.

(21) Appl. No.: 11/125,729

(22) Filed: May 10, 2005

(51) Int. Cl.
*A47C 1/02* (2006.01)

(52) U.S. Cl. ..... 297/68; 297/68; 297/362.13

(58) Field of Classification Search ..... 297/68, 297/69, 88, 362.13, 423.3
See application file for complete search history.

(56) References Cited

U.S. PATENT DOCUMENTS 2,016 A * 3/1841 Smith ..... 126/500
3,081,128 A * 3/1963 Schliephacke ..... 297/88
5,015,031 A * 5/1991 Horenkamp ..... 297/84
2002/0030389 A1* 3/2002 Panton ..... 297/68
2003/0080597 A1* 5/2003 Beroth et al. ..... 297/330
2006/0076807 A1* 4/2006 Gaikwad et al. ..... 297/71
2006/0082195 A1* 4/2006 Jiang ..... 297/68
2006/0103218 A1* 5/2006 De Vroe ..... 297/423.26

* cited by examiner

*Primary Examiner*—Peter M. Cuomo
*Assistant Examiner*—Sarah B. McPartlin
(74) *Attorney, Agent, or Firm*—Ladas & Parry LLP

(57) ABSTRACT

A chair includes a mounting frame, a chair seat frame movable relative to the mounting frame longitudinally between a forward position and a rearward position, a footrest mounted pivotally to a front seat portion of the chair seat frame and an anchored portion of the mounting frame at two pivot regions so as to be turnable from a low-lying position to a raised position when the chair seat frame is moved from the forward position to the rearward position, a guiding mechanism disposed to guide movement of the chair seat frame relative to the mounting frame, and a backrest unit disposed to be turned relative to the chair seat frame between an upright position and an inclined position.

9 Claims, 7 Drawing Sheets

CHAIR WITH A FOOTREST TURNABLE RELATIVE TO A CHAIR SEAT FRAME

BACKGROUND OF THE INVENTION

1. Field of the Invention

This invention relates to a chair, more particularly to a chair with a footrest that is turnable relative to a chair seat frame between a low-lying position and a raised position.

2. Description of the Related Art

Chairs are designed to provide a variety of functions. Some are ergonomically designed to enhance comfort. Some have a light and simple construction. Some have an adjustable backrest and an adjustable footrest, etc., to meet different requirements of the users. In one design, the chair is provided with a seat that can be adjusted relative to a seat base by virtue of movement of the body weight of a seated person for synchronously actuating both a footrest and a backrest to a desired inclination position. However, such chair is complicated in construction and is inconvenient to assemble. Moreover, it does not appeal to users that prefer a chair with a footrest and a backrest that can be adjusted individually.

SUMMARY OF THE INVENTION

The object of the present invention is to provide a chair which has a footrest and a backrest that can be assembled conveniently and that can be adjusted relative to a chair seat frame with ease.

Another object of the present invention is to provide a chair which has a footrest and a backrest that can be adjusted individually.

According to this invention, the chair includes a support leg unit having lower and upper portions opposite to each other in an upright direction. A mounting frame includes uprightly extending left and right side members opposite to each other in a transverse direction, a mounting crosspiece which is secured to the upper portion and which interconnects the left and right side members, and a cantilevered member which has an anchoring portion secured to the mounting crosspiece, and an anchored portion that is opposite to the anchoring portion in a longitudinal direction and that extends to form left and right anchored ends. A chair seat frame includes a rear seat portion which has left and right coupling ends that are respectively movable relative to the left and right side members in the longitudinal direction between a forward position and a rearward position, and a front seat portion which has left and right pivoted ends that are respectively proximate to the left and right anchored ends. A footrest has two proximate ends mounted pivotally on the left and right pivoted ends, respectively, about a first pivot axis in the transverse direction, two distal ends which are turnable between a low-lying position and a raised position, and two linked regions which are respectively coupled to the left and right anchored ends about a second pivot axis in the transverse direction such that when the left and right coupling ends of the rear seat portion are moved from the forward position to the rearward position, the distal ends are turned from the low-lying position to the raised position. A guiding mechanism is disposed to guide movement of the left and right coupling ends of the rear seat portion relative to the left and right side members, respectively, in the longitudinal direction.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
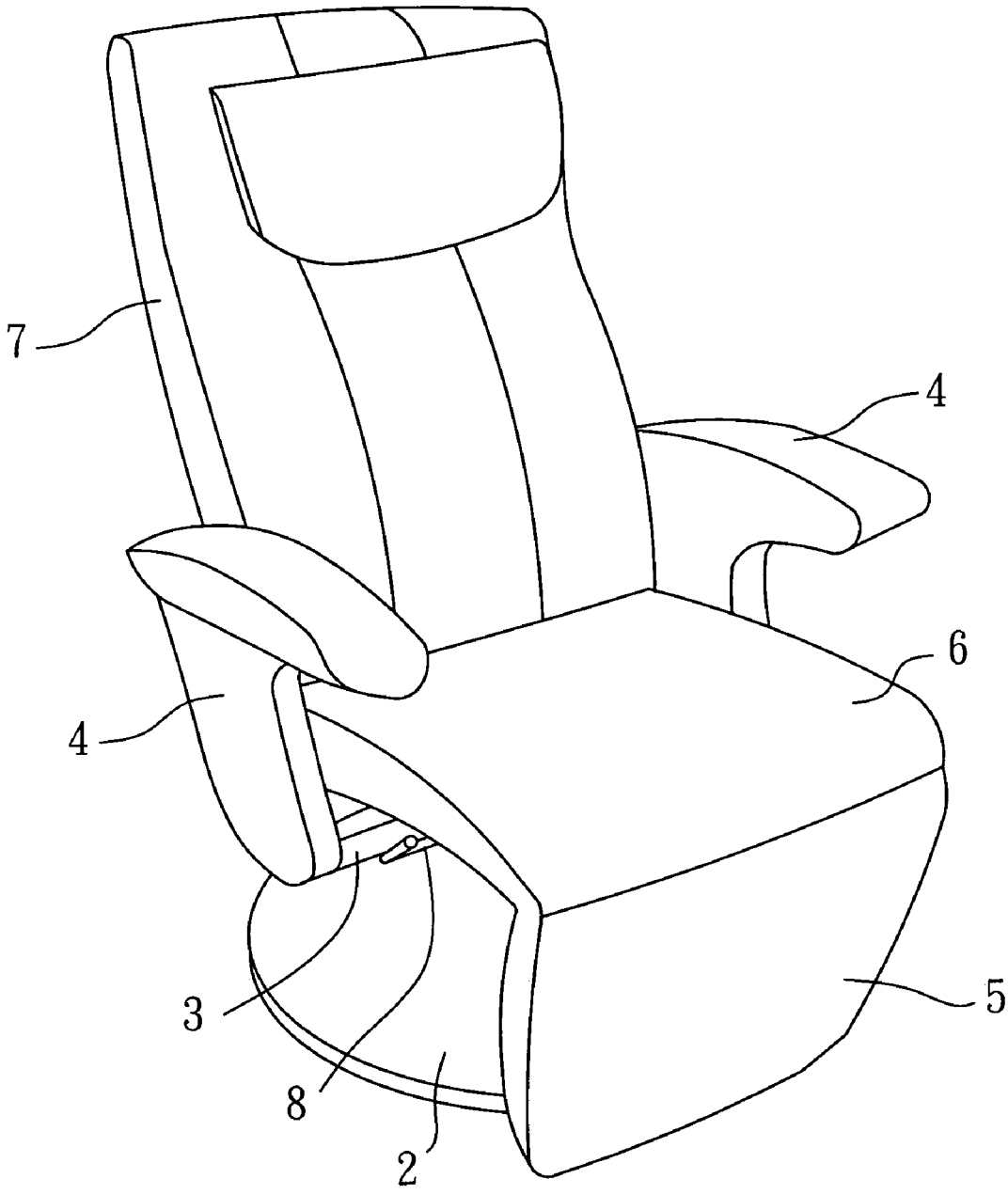
FIG. 1 is a perspective view of the preferred embodiment of a chair according to this invention.
Figure 2:
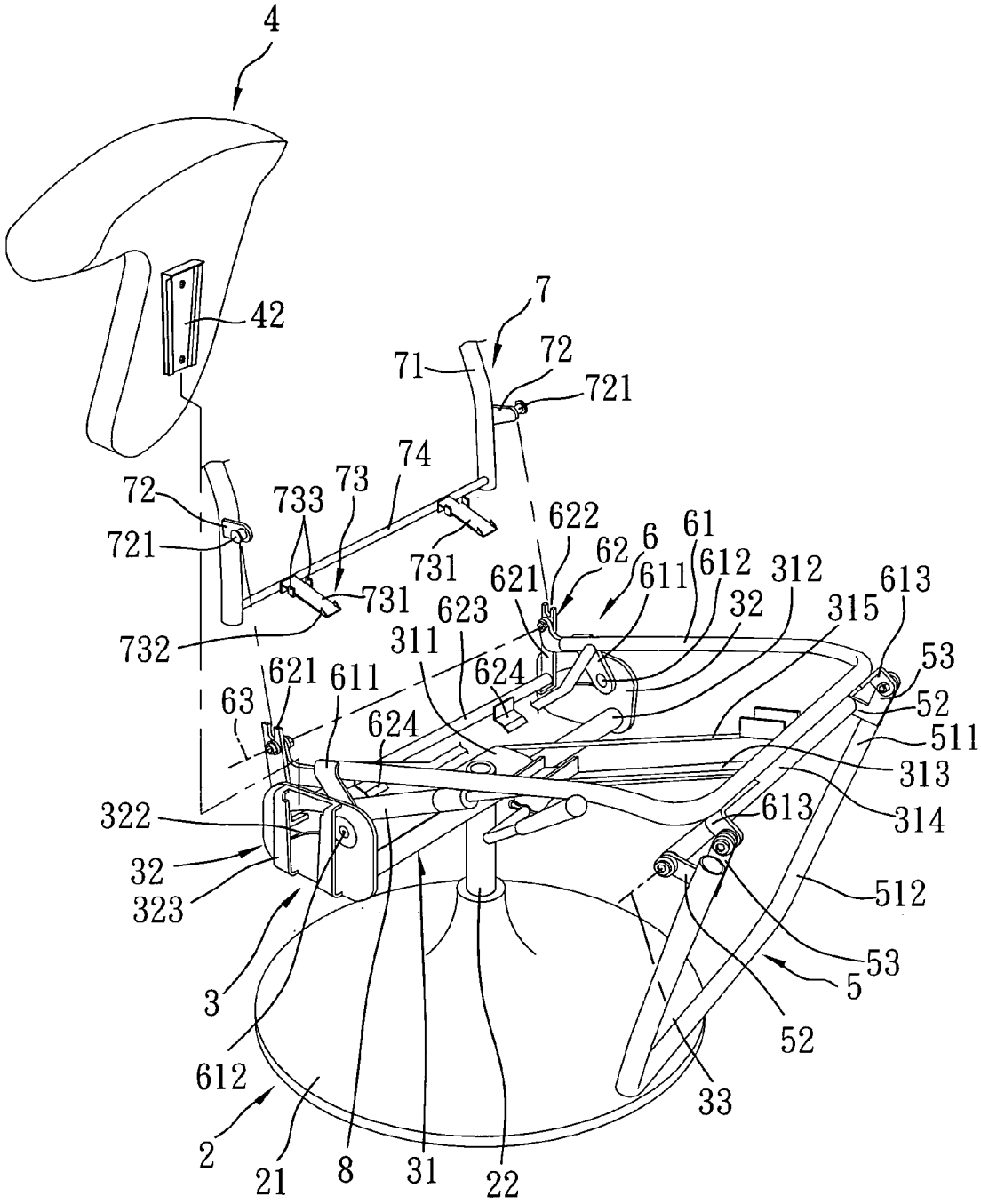
FIG. 2 is a fragmentary exploded perspective view of the preferred embodiment.

Referring to FIGS. 1 and 2, the preferred embodiment of a chair according to the present invention is shown to comprise a support leg unit 2, a mounting frame 3, left and right armrests 4, a chair seat 6, a footrest 5, a backrest unit 7, and a telescopic unit 8.

The support leg unit 2 has a lower portion 21 adapted to stand on a floor surface, and an upper portion 22 extending from the lower portion 21 in an upright direction.

Figure 3:
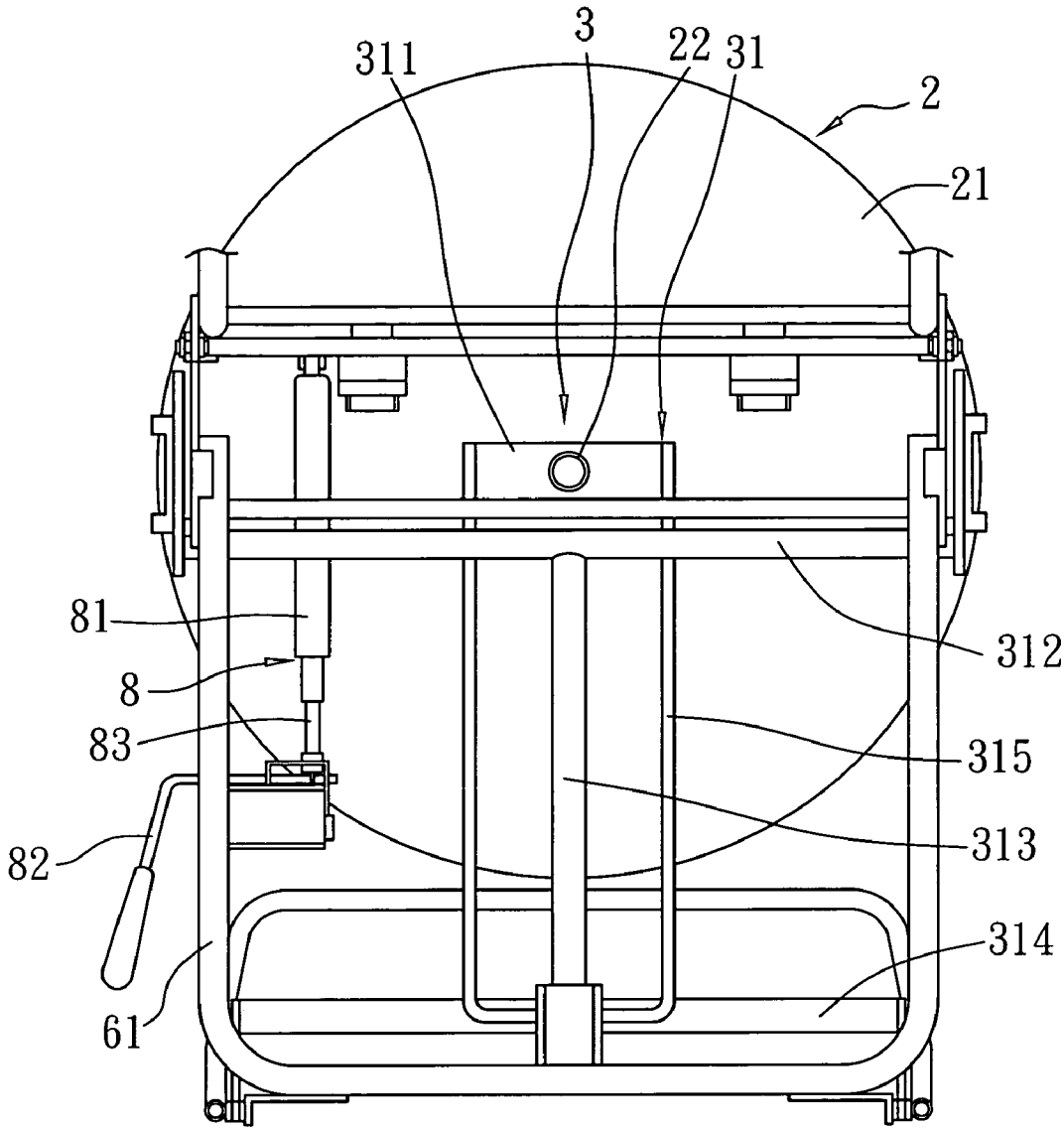
FIG. 3 is a fragmentary top view of the preferred embodiment.

With reference to FIGS. 2 and 3, the mounting frame 3 includes a mounting base 31 and left and right side members 32. The mounting base 31 includes a mounting portion 311 which is fittingly and detachably sleeved on the upper portion 22 of the support leg unit 2, a mounting crosspiece 312 which is welded to the mounting portion 311 and which extends in a transverse direction relative to the upright direction, a cantilever member which has an anchoring portion 313 that is welded to the mounting crosspiece 312 and an anchored portion 314 that is opposite to the anchoring portion 313 in a longitudinal direction transverse to the upright and transverse directions and that extends to form left and right anchored ends opposite to each other in the transverse direction, and a U-shaped reinforcing shaft 315 which is connected to the mounting portion 311 and the anchored portion 314. The left and right side members 32 are secured to two ends of the mounting crosspiece 312, and extend in the upright direction.

The left and right armrests 4 are detachably fitted to and are disposed leftwardly and rightwardly of the left and right side members 32, respectively, by means of left and right interlocking joints. Each interlocking joint includes a socket 323 and a plug 42 which are of a wedge-shape, which are disposed on the corresponding side member 32 and the corresponding armrest 4, respectively, and which are matingly fitted to each other in the upright direction.

Figure 4:
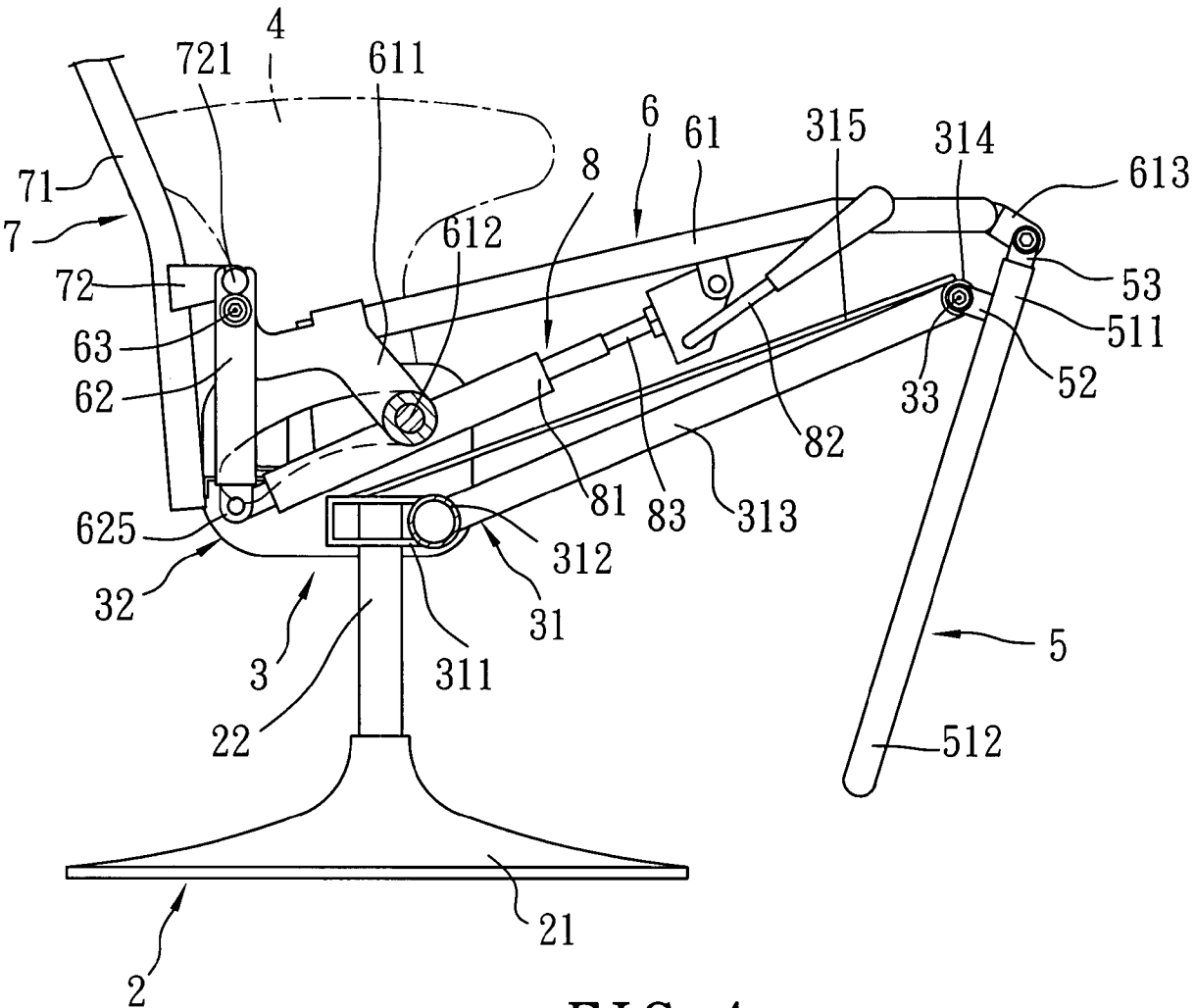
FIG. 4 is a fragmentary side view of the preferred embodiment when a footrest is in a low-lying position and a backrest is in an upright position.

With reference to FIGS. 2 and 4, the chair seat 6 includes a chair seat frame 61 and a backrest coupling frame 62. The chair seat frame 61 has front and rear seat portions disposed opposite to each other in the longitudinal direction. The front seat portion has left and right pivoted ends 613 opposite to each other in the transverse direction and respectively proximate to the left and right anchored ends of the anchored portion 314. The rear seat portion has left and right coupling ends 611 which are disposed between the left and right side members 32. A guiding mechanism includes left and right key slots 322 which are formed in the left and right side members 32, respectively, and which extend in the longitudinal direction, and left and right keys 612 which are respectively disposed on the left and right coupling ends 611 of the rear seat portion, which extend in the transverse direction, and which are slidable in the left and right key slots 322, respectively, so as to guide movement of the left and right coupling ends 611 in the longitudinal direction, thereby enabling the chair seat frame 61 to move between a forward position and a rearward position.

The backrest coupling frame 62 has left and right stumps 621 which are pivotally mounted on the left and right coupling ends 611 of the rear seat portion about a pivot axis 63 (a third pivot axis) in the transverse direction so as to be turned about the third pivot axis 63 relative to the chair seat frame 61 between an upright position and an inclined position.

Figure 5:
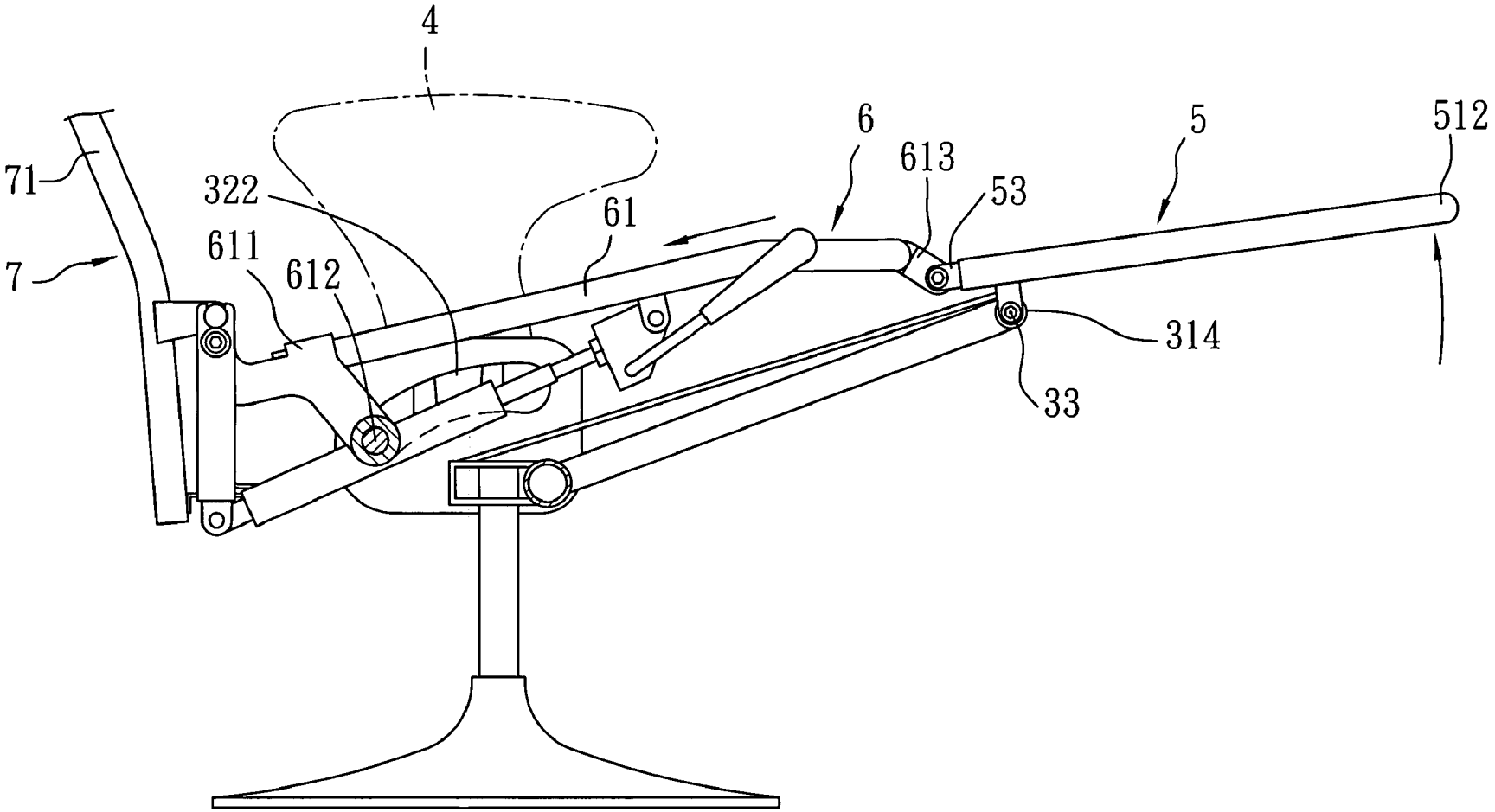
FIG. 5 is a fragmentary side view of the preferred embodiment when the footrest is in a raised position and the backrest is in the upright position.

The footrest 5 has two proximate ends 511 with pivot lugs 53 which are mounted pivotally on the left and right pivoted ends 613, respectively, about a first pivot axis in the transverse direction, two distal ends 512 which are opposite to the proximate ends 511 and which are turnable about the first pivot axis between a low-lying position and a raised position, and two linked regions 52 in the form of pivot lugs which are mounted pivotally to the left and right anchored ends of the anchored portion 314 about a second pivot axis 33 in the transverse direction, and each of which is disposed between the respective proximate end 511 and the respective distal end 512 and adjacent to the proximate end 511. Thus, when the left and right coupling ends 611 of the chair seat frame 61 are moved from the forward position (see FIG. 4) to the rearward position (see FIG. 5), the distal ends 512 of the footrest 5 are turned from the low-lying position to the raised position. Particularly, in operation, the seated person can grip the armrests 4 and apply a forward force to the armrests 4 so as to enable the chair seat frame 61 to move from the forward position to the rearward position by virtue of a reacting force. During the rearward movement of the chair seat frame 61, the pivot lugs 53 are moved rearwardly so as to turn the footrest 5 about the second pivot axis 33 from the low-lying position to the raised position. Furthermore, when it is desired to turn the footrest 5 back to the low-lying position, the seated person can press the footrest 5 downwardly so as to move the chair seat frame 61 from the rearward position to the forward position. Therefore, adjustment of the footrest 5 is convenient and easy to conduct.

Figure 6:
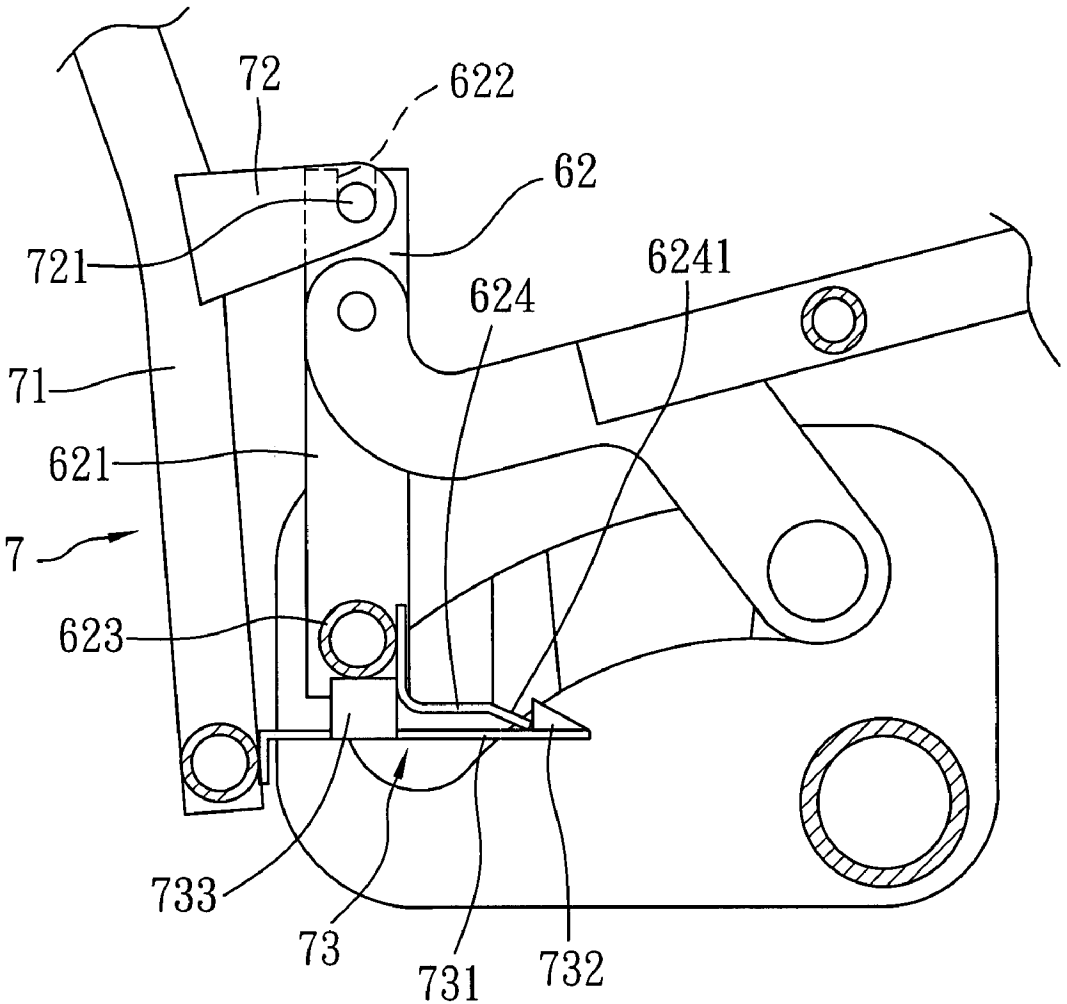
FIG. 6 is a fragmentary, partially sectioned side view of an arrest member of the preferred embodiment.

With reference to FIGS. 2, 4 and 6, the backrest unit 7 has left and right stiles 71 which are opposite to each other in the transverse direction and which are respectively coupled to the left and right stumps 621 so as to be turned therewith between the upright and inclined positions, and a cross rail 74 extending in the transverse direction to interconnect the left and right stiles 71.

Specifically, the backrest coupling frame 62 has left and right engaging rests 622 in the form of concavities which are disposed on the left and right stumps 621, respectively, and which face upwardly, and an interconnecting shaft 623 which extends in the transverse direction to interconnect the left and right stumps 621. The backrest unit 7 has left and right lugs 72 which respectively extend from the left and right stiles 71 forwardly and in the longitudinal direction and which respectively have left and right engaging pins 721 that extend respectively from the left and right lugs 72 in the transverse direction so as to be journalled respectively on the left and right engaging rests 622 about a fourth axis. An arrest member 73 includes a plurality of hooked plates 624 which extend forwardly from the interconnecting shaft 623 and which respectively terminate at front hooked edges 6241, a plurality of hook tongues 731 which extend forwardly from the cross rail 74 and which respectively terminate at hook edges 732, and a plurality of arresting pieces 733 which are respectively disposed on the hook tongues 731. In assembling the backrest unit 7 to the backrest coupling frame 62, the hook tongues 731 are brought to slide undersides of the hooked plates 624. A frictional force is generated therebetween so as to vest the front hook edges 6241 with a biasing force that urges the hook edges 732 upward. Once the hook edges 732 are forced to slip past the hooked edges 6241, the hook edges 732 are biased upwards so as to be retained relative to the front hooked edges 6241. Meanwhile, the arresting pieces 733 are engaged with rear portions of the respective hooked plates 624, thereby guarding against turning movement of the backrest unit 7 relative to the backrest coupling frame 62 about the fourth axis, as shown in FIG. 6. Furthermore, pressing of the hook tongues 731 enables the hook edges 732 to move downwardly of the hooked plates 624 so as to permit disengagement of the hook tongues 731 from the hooked plates 624.

Figure 7:
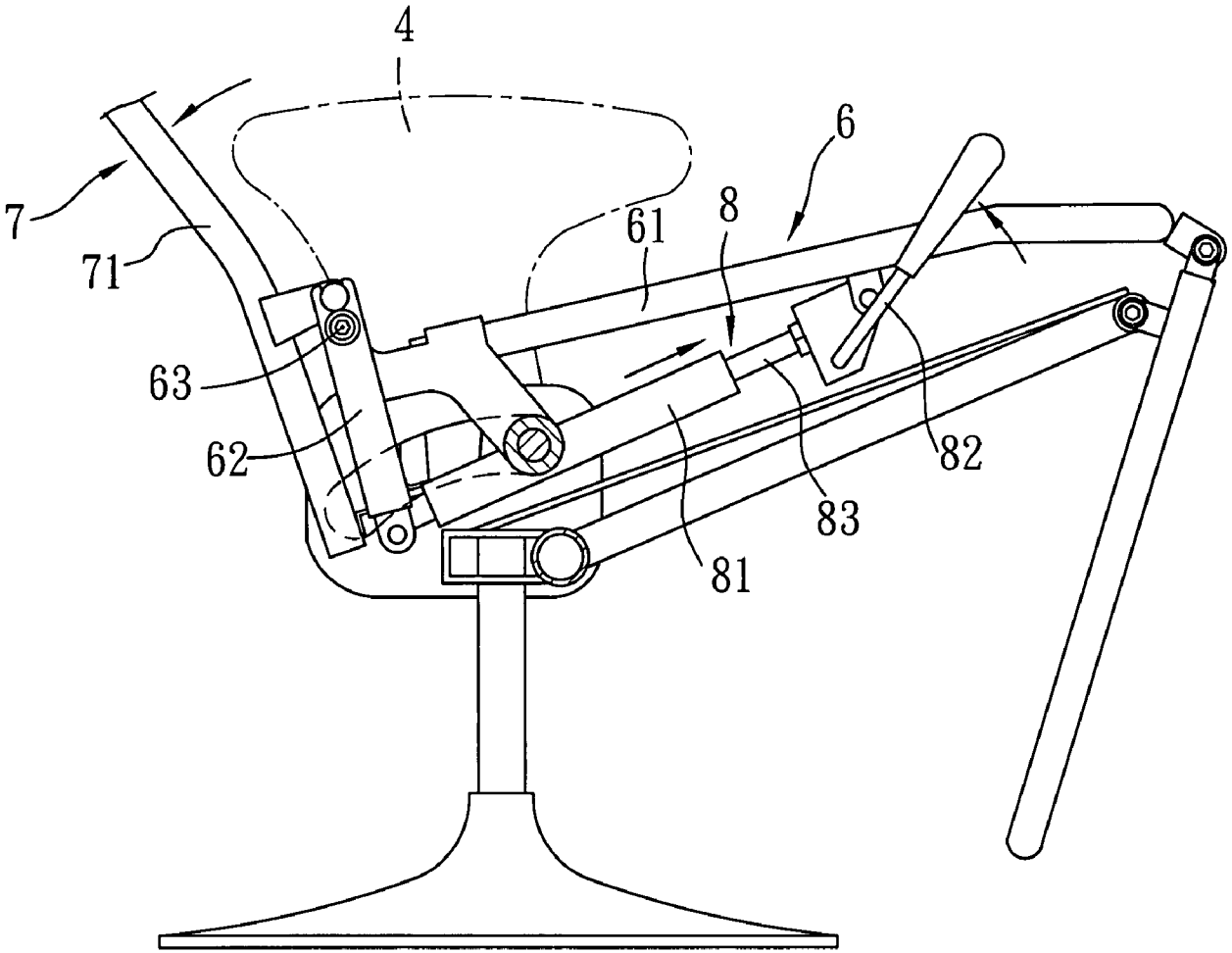
FIG. 7 is a fragmentary side view of the preferred embodiment when the footrest is in the raised position and the backrest is in an inclined position.

With reference to FIGS. 2 and 4, the telescopic unit 8 is pneumatically actuable, and includes a cylinder 81 and a piston rod 83 which are respectively connected to the chair seat frame 61 and a lower seat 625 of the backrest coupling frame 62 and which are fitted to each other so as to permit lengthening or shortening of the telescopic unit 8 when actuated pneumatically, thereby placing the backrest coupling frame 62 and the backrest unit 7 in the upright position (see FIG. 4) or the inclined position (see FIG. 7), respectively. An actuating member 82 in the form of an actuating lever is operable to actuate the telescopic unit 8 pneumatically. It is noted that in a vacant state where no person is seated on the chair and the actuating member 82 is not operated, the backrest unit 7 is maintained in the upright position by virtue of air pressure within the telescopic unit 8. Thus, the backrest unit 7 can be adjusted between the upright and inclined positions independently of the footrest 5, and can be inclined at a desired inclination position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A chair comprising:

a support leg unit having a lower portion adapted to stand on a floor surface, and an upper portion opposite to said lower portion in an upright direction;

a mounting frame including left and right side members opposite to each other in a transverse direction relative to the upright direction and each extending in the upright direction, a mounting crosspiece which is secured to said upper portion and which extends in the transverse direction to interconnect said left and right side members, and a cantilevered member which has an anchoring portion secured to said mounting crosspiece, and an anchored portion that is opposite to said anchoring portion in a longitudinal direction transverse to the upright and transverse directions and that extends to form left and right anchored ends opposite to each other in the transverse direction;

a chair seat frame having front and rear seat portions disposed opposite to each other in the longitudinal direction, said rear seat portion having left and right coupling ends which are respectively proximate to said left and right side members and which are respectively movable relative to said left and right side members in the longitudinal direction between a forward position and a rearward position, said front seat portion having left and right pivoted ends which are opposite to each other in the transverse direction and which are respectively proximate to said left and right anchored ends;

a footrest having two proximate ends which are mounted pivotally on said left and right pivoted ends, respectively, about a first pivot axis in the transverse direction, two distal ends which are opposite to said proximate ends and which are turnable about the first pivot axis between a low-lying position and a raised position, and two linked regions, each of which is disposed between a respective one of said proximate ends and a respective one of said distal ends and adjacent to said proximate ends, and which are respectively coupled to said left and right anchored ends about a second pivot axis in the transverse direction such that when said left and right coupling ends of said rear seat portion are moved from the forward position to the rearward position, said distal ends are turned from the low-lying position to the raised position; and a guiding mechanism disposed to guide movement of said left and right coupling ends of said rear seat portion relative to said left and right side members, respectively, in the longitudinal direction.

2. The chair of claim 1, wherein said guiding mechanism includes left and right key slots which are formed in said left and right side members, respectively, and which extend in the longitudinal direction, and left and right keys which are disposed on said left and right coupling ends of said rear seat portion, respectively, which extend in the transverse direction, and which are slidable in said left and right key slots, respectively, so as to guide movement of said left and right coupling ends in the longitudinal direction.

3. The chair of claim 1, further comprising left and right armrests which are fitted to and which are disposed leftwardly and rightwardly of said left and right side members, respectively.

4. The chair of claim 3, further comprising left and right interlocking joints respectively disposed to enable said left and right armrests to move in the upright direction so as to be fitted to said left and right side members, respectively.

5. The chair of claim 1, further comprising:

a backrest coupling frame having left and right stumps which are pivotally mounted on said rear seat portion of said chair seat frame about a third pivot axis in the transverse direction so as to be turned about the third pivot axis relative to said rear seat portion between an upright position and an inclined position; and a backrest unit having left and right stiles which are opposite to each other in the transverse direction and which are respectively coupled to said left and right stumps so as to be turned therewith between the upright and inclined positions, and a cross rail extending in the transverse direction to interconnect said left and right stiles.

6. The chair of claim 5, further comprising a telescopic unit which is pneumatically actuable and which includes a cylinder and a piston rod that are connected to said chair seat frame and said backrest coupling frame and that are fitted to each other so as to permit lengthening or shortening of said telescopic unit when actuated pneumatically, thereby placing said backrest unit in the upright or inclined positions.

7. The chair of claim 6, further comprising an actuating member disposed to actuate said telescopic unit pneumatically.

8. The chair of claim 5, wherein said backrest coupling frame has left and right engaging rests which are disposed on said left and right stumps, respectively, and which face upwardly, and an interconnecting shaft which extends in the transverse direction to interconnect said left and right stumps, said backrest unit having left and right lugs which respectively extend from said left and right stiles forwardly and in the longitudinal direction and which respectively have left and right engaging pins that extend respectively from said left and right lugs in the transverse direction so as to be journalled respectively on said left and right engaging rests about a fourth axis, said chair further comprising an arrest member disposed to guard against turning movement of said left and right engaging pins relative to said left and right engaging rests, respectively, about the fourth axis.

9. The chair of claim 8, wherein said arrest member includes a hooked plate which extends forwardly from said interconnecting shaft and which terminates at a front hooked edge, a hook tongue which extends forwardly from said cross rail and which terminates at a hook edge such that when said hook tongue is brought to slide along an underside of said hooked plate, a frictional force is generated therebetween so as to vest said hook edge with a biasing force that urges said hook edge upward, and such that once said hook edge is forced to slip past said front hooked edge, said hook edge is biased upwards so as to be retained relative to said front hooked edge.

* * * * *